US006726770B2

(12) United States Patent
Eichinger

(10) Patent No.: US 6,726,770 B2
(45) Date of Patent: Apr. 27, 2004

(54) APPLICATOR DEVICE

(75) Inventor: Kurt Eichinger, Wilhelmsburg (AT)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/184,362

(22) Filed: Jun. 27, 2002

(65) Prior Publication Data

US 2003/0000465 A1 Jan. 2, 2003

(30) Foreign Application Priority Data

Jun. 29, 2001 (DE) ..... 101 31 680

(51) Int. Cl.[7] ..... B05C 3/02
(52) U.S. Cl. ..... 118/405; 118/325; 118/419
(58) Field of Search ..... 118/405, 419, 118/325, 304, 424, 404, 414; 427/209, 211, 424, 434.2, 434.4

(56) References Cited

U.S. PATENT DOCUMENTS 4,231,318 A * 11/1980 Zink
4,712,506 A 12/1987 Rantanen et al. ..... 118/103
4,822,640 A * 4/1989 Tuhkanen et al.

FOREIGN PATENT DOCUMENTS

| | | | |
|---|---|---|---|
| DE | 3811315 | 10/1989 | ..... 3/18 |
| DE | 29513970 | 1/1996 | ..... 1/8 |
| DE | 10032500 | 1/2002 | ..... 1/8 |
| GB | 2091598 | 8/1982 | ..... 3/12 |
| GB | 2138325 | 10/1984 | ..... 3/12 |
| JP | 60-179167 | 9/1985 | ..... 3/12 |

* cited by examiner

*Primary Examiner*—Brenda A. Lamb
(74) *Attorney, Agent, or Firm*—Taylor & Aust, P.C.

(57) ABSTRACT

An application device for applying an application medium to at least one side of a moving product web, the web having a running direction. The application device includes at least one roll supporting the web, at least one pocket between at least one roll and at least one side, at least one pocket having a size and a shape, at least one feed apparatus including a metering element, the metering element having at least one discharge nozzle projecting into at least one pocket and at least one application chamber designed into the metering element, at least one discharge nozzle discharging the application medium onto the web in a first direction and proximate to at least one application chamber, the first direction approximately orthogonal to the running direction.

29 Claims, 2 Drawing Sheets

APPLICATOR DEVICE

BACKGROUND OF THE INVENTION

1. Field of the Invention

The present invention relates to a device for applying a liquid medium to a moving product web, particularly a board web.

2. Description of the Related Art

An applicator device has been described in DE 10032500.9. In the case of this device, which is used to apply a liquid medium to one or both sides of a moving product web, especially a board web, the web runs over a roll or runs through a nip between two rolls.

At least one feed apparatus for the application medium is provided. Under operating conditions, a liquid pond then forms between the rolls or between one roll and the web. In this area of the pond, the application medium, in particular size or starch, penetrates into the product web, that is to say penetrates into the web. Specific properties of the web are intended to be changed and improved thereby.

By way of specifically shaped nozzle lips, which can be fitted to the nozzle element of the feed apparatus, the desired size of the free surface of the pond and also the immersion depth or the level can be adjusted. In order to feed the pond on one or on both sides of the web, use is made in each case of a feed apparatus having the aforementioned nozzle element and the nozzle lips. In this case, the nozzle lips form the discharge opening for the application medium.

In the case of the aforementioned solution, the nozzle lips, including the discharge opening, project into the pocket existing between material web and roll. The application medium flows approximately parallel to the running direction of the web and the roll or rolls. Nevertheless, the flow behavior of the application medium in the pond is not yet optimal. At higher required running speeds of the size press, increased and undesired eddy formation is conceivable.

SUMMARY OF THE INVENTION

The present invention provides an applicator device with which the running properties and the application options of size presses can be improved further and with which adequate penetration of the application medium into the product web, particularly into a board web, is also possible.

The invention comprises, in one form thereof, an application device for applying an application medium to at least one side of a moving product web, the web having a running direction. The application device includes at least one roll supporting the web, at least one pocket between at least one roll and at least one side, at least one pocket having a size and a shape, at least one feed apparatus including a metering element, the metering element having at least one discharge nozzle projecting into at least one pocket and at least one application chamber designed into the metering element, at least one discharge nozzle discharging the application medium onto the web in a first direction and proximate to at least one application chamber, the first direction approximately orthogonal to the running direction.

The applicator device according to the present invention is particularly suitable for the treatment of a board web.

The provision of an application chamber that projects into the pocket between roll and moving product web and from which the application medium strikes the web in an approximately orthogonal direction, that is to say transversely with respect to the running direction of the web, has a plurality of advantages. Some of the advantages of the present invention as compared with the solution cited in the description of the related art are:

1. Improvement of the flow conditions in pond operation.
2. The introduction of the application medium can be carried out with a precisely defined quantity and an appropriately defined pressure.
3. Less mist formation and less spray.
4. Reduction of the quantity of application medium etc. to be provided.

In this connection, it is very advantageous to arrange the application chamber, in which a medium pressure is built up, to be very close, that is to say at only the minimum distance from the product web to which the application medium is to be applied. As a result, there is the possibility of reducing the compressive penetration in the roll nip, as a result of which the product web is stressed less.

The applicator device according to the present invention can be operated both with normal pond operation and with a low pond level in the pocket.

One advantage of the present invention is the application possibilities for an extremely wide range of paper grades, running properties and application medium types are increased by a multiple.

With the applicator device according to the present invention, it is also possible to set only a low nip load, as a result of which, for example, the volume of a board web is preserved. The fact that only a low nip load (compressive force) is needed between board web and the roll or in the nip between two rolls implies that the rolls do not have to be highly dimensioned, which results in considerable savings in material and costs for the applicator device.

A further advantageous achievement of the present invention is that the nozzle element, that is to say the application chamber, can be equipped with discharge nozzles, which can be in the form of spray nozzles.

The spray nozzles, which can be arranged within the pressure application chamber in one or more planes, firstly ensure particularly gentle application. As a result, optimum surface consolidation of the fibers of board, when starch is used, and also keeping it free from dust is made possible, especially when processing board.

Secondly, the same applicator device permits use even in the case of graphic papers to which pigment-containing coating color is to be applied. In this case, a pond level is generally dispensed with and, in addition, the operating speeds are in this case generally significantly higher. Even a 1:1 application would be possible in this case without subsequent equalization of the applied coating color.

However, the applicator device according to the present invention is also further suitable for "normal" pond operation. Such an operation is advantageous when fluting medium or liner is to be treated with starch or size and, for this purpose, a higher penetration than in the case of board is required.

In the case of board, on the other hand, a lower penetration is adequate, since as a rule the intention here is only to bond the raw material particles at the surface of the web.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
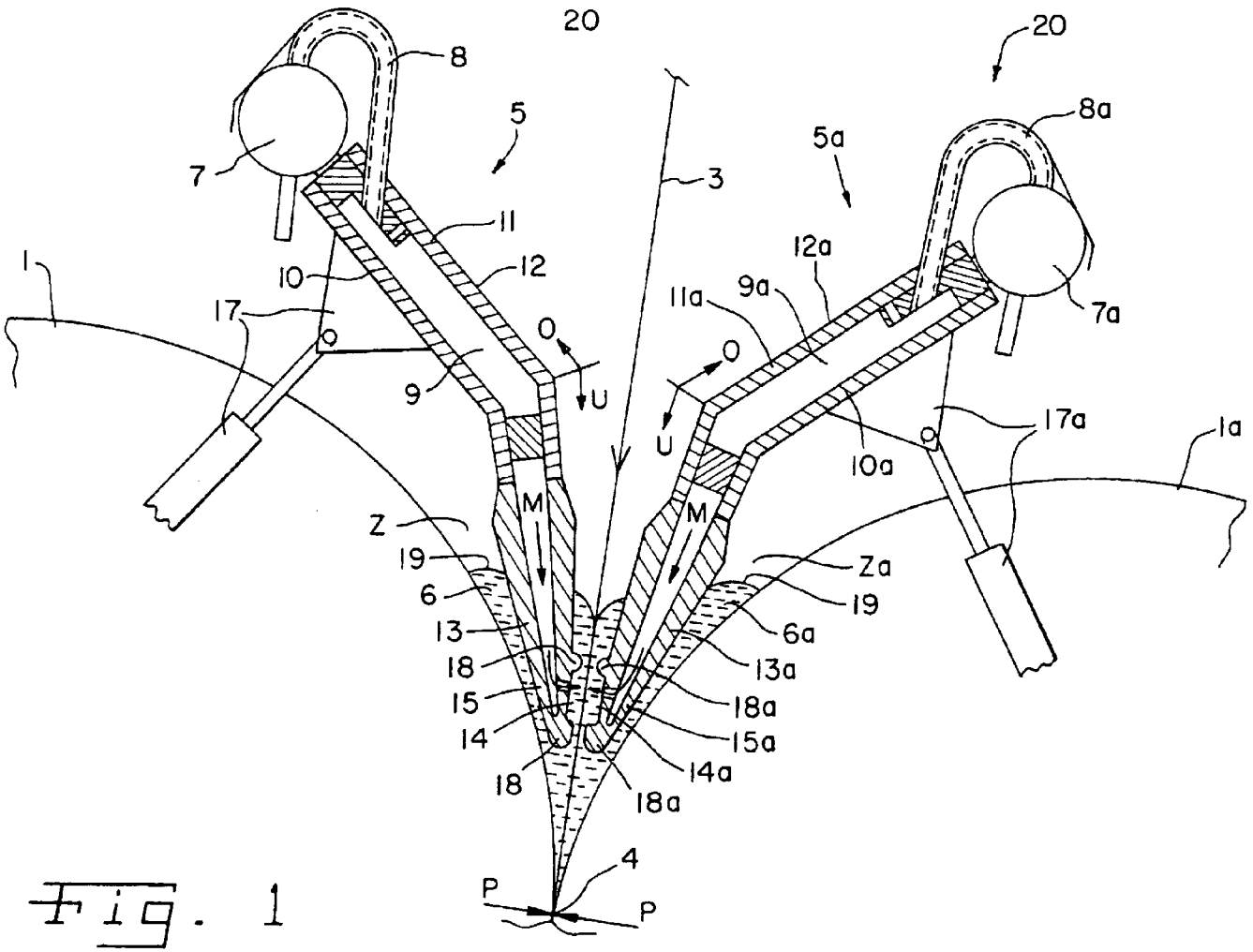
FIG. 1 is a partially schematic side view of an embodiment of the application device according to the present invention with pond operation.

Referring now to the drawings, and more particularly to FIG. 1, an embodiment of an applicator device shown generally at 20 is preferably used for simultaneous application to both sides of product web 3, product web 3 having a running direction shown by the arrow. Quite often, only single-sided application to only one of the two sides of web 3 is also provided.

In order to distinguish between the components, which are basically of identical construction, on the right-hand half of the picture the components are named with the note "a". In the case of single-sided application, all the components on the left-hand or the right-hand half of the picture can either be left out completely or merely pivoted away.

Figure 2:
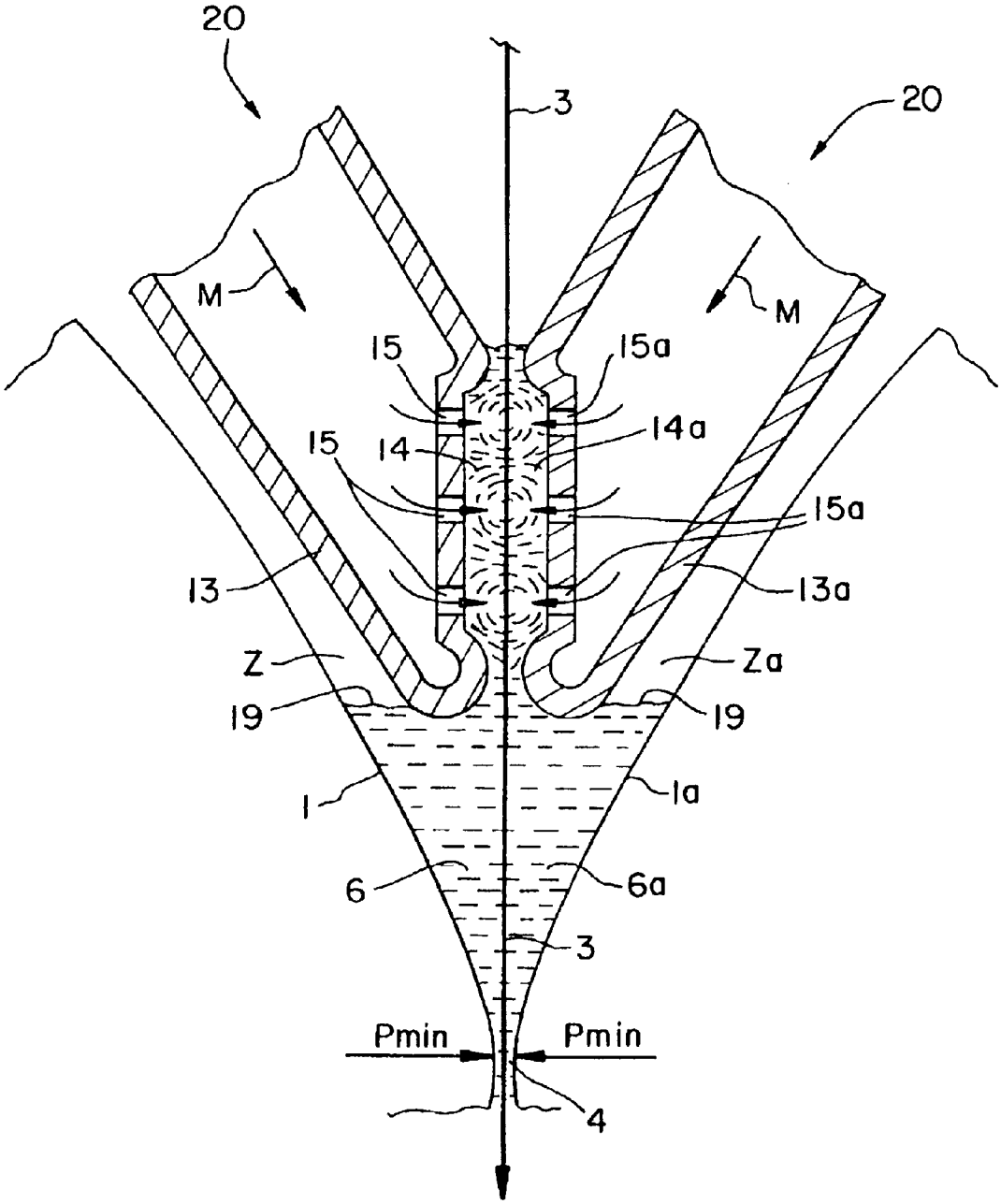
FIG. 2 is a partially schematic side view detailed illustration of the application location of an embodiment of the present invention with a low pond.

FIGS. 1 and 2 show two rolls 1 and 1*a*, which form with each other a nip 4 (press nip) through which board web 3 runs. Web 3 runs through the nip substantially from top to bottom.

In the embodiment according to FIG. 1, which is primarily envisaged for the treatment of liner or fluting medium, there is in each case an application medium feed apparatus 5 and 5*a* on both sides of web 3.

Between the respective web side and each of rolls 1 and 1*a* there are pockets Z and Za, which during the operation of devices 20 are in each case filled with pond 6 and 6*a*, respectively. As a result, depending on medium M used, web 3 is impregnated, sized or, in the example, the surface of web 3 is consolidated. Pockets Z and Za each have a size and a shape determined, in part, by the diameter of rolls 1 and 1*a*, respectively.

As FIG. 1 shows, feed apparatus 5 and 5*a* includes a main distribution pipe 7 and 7*a*, respectively. Like all the other components, main distribution pipe 7 and 7*a* is likewise designed to be of machine width and receives the application medium M at its ends.

In each case a large number of individual distribution pipes 8 and 8*a* open into main distribution pipe 7 and 7*a* and are arranged uniformly over the length of main distribution pipe 7 and 7*a*. Via the plurality of pipes 8 and 8*a*, quite specific quantities of application medium M can be fed into metering gaps 9 and 9*a*, respectively, so that a uniform feed over the entire web width, and therefore a uniform pressure distribution over a specific chamber 14 or 14*a* (which will be explained further below) is possible. Metering gaps 9 and 9*a* are located in the interspace between parallel walls 10 and 11, and 10*a* and 11*a*, respectively, which reach over the entire width of device 20 and of which metering elements 12 and 12*a* are composed.

The lower part of the metering element, that is that part which projects into the pocket Z or Za, includes specially shaped attachments 13 or 13*a*. Attachments 13 and 13*a* are produced as an individual part in various sizes. Its outer surfaces are arranged to converge toward each other. In the outer surface pointing toward the product web 3, a machine-width depression with edge beads 18 and 18*a* (or similar limiting elements such as walls) is made which, as a result, forms application chambers 14 or 14*a* mentioned previously.

By changing the position of chambers 14 or 14*a* in relation to product web 3, or varying the distance of beads 18 and 18*a*, or else by replacing nozzle element attachments 13 or 13*a* with an attachment of another size, or varying the size of application chambers 14 or 14*a* and therefore the pressure to be applied, the quantity of application medium can be adjusted. Application chambers 14 and 14*a* are in each case arranged at the minimum distance from the moving web.

As a result of application medium M flowing in from metering gaps 9 or 9*a* via discharge nozzles 15 or 15*a* (which can alternatively be discharge openings or spray nozzles), a pressure is built up with which, firstly, web 3 can have medium M applied to it very uniformly, and, secondly, undesired eddy formation in ponds 6 and 6*a*, and misting and spray are avoided, or at least reduced.

FIG. 1 also reveals that metering element 12 or 12*a*, that is to say walls 10, 11 or 10*a*, 11*a*, respectively, are designed in two parts. Upper part O and lower part U (lower part U being that part to which attachment 13 or 13*a* is fitted and projects into ponds 6 or 6*a*) are connected to each other detachably, for example by way of a screw fitting or a hinge arrangement.

This two-part design has advantages in production and in assembly, dismantling or when cleaning the applicator device 20. Furthermore, kits of different lengths can be provided for upper part O and lower part U, by which elements device 20 according to the present invention can easily be adapted to different roll 1, 1*a* diameters.

By using the pivoting device 17 or 17*a*, firstly the position of application chambers 14 or 14*a*, respectively, can be adjusted.

Secondly, the entire feed apparatus 5 and 5*a* can be lifted out of rolls 1 and 1*a* or, put in a better way, can be lifted out of pockets Z and Za or nip 4 within pond 6 or 6*a*. This is necessary in particular when only one side of the web is to be treated, when rolls are to be cleaned or replaced or when a web break has to be dealt with.

Application devices shown generally at 20 in FIG. 2 are basically the same construction as device 20 in FIG. 1 and is therefore also provided with the same reference symbols. However, in the alternative embodiment according to FIG. 2, only a weak or low pond 6 or 6*a* is built up, for which reason the application area is only illustrated as a detail.

This alternative embodiment is primarily suitable for the surface consolidation of board, where the volume is not to be compressed in nip 4. In addition, in this case no complete through penetration is necessary.

The application chamber 14 or 14*a*, in which a plurality of discharge nozzles in the form of spray nozzles 15 and 15*a* are advantageously incorporated, for example in a plurality of planes, permit this gentle mode of operation at only a low nip load Pmin to be set. Spray nozzles 15 and 15*a* impinge application medium M directly onto web 3.

It is even possible for applicator rolls 1 and 1*a* to be used with significantly smaller diameters than hitherto, since here no large circumferential surfaces of the rolls are needed in order to build up a voluminous pond level 9. Accordingly, this variant is very economical. In addition, the expenditure on roll drive power is substantially reduced. Likewise, the expenditure for application medium M and for pump circulation is considerably reduced, because of the possible use of spray nozzles 15 and 15*a*.

It should further be mentioned that, when spray nozzles 15 and 15*a* are used, even graphic paper can be treated with pigment-containing coating color, and in this case an application without excess is possible, since by using the spray nozzles, it is possible to perform very fine distribution of the application medium.

In the cases of pond 6, 6*a* operation, shown in FIGS. 1 and 2, excess application is carried. out, however, which can generally be followed by a board coating device arranged physically downstream of applicator device 20 but not illustrated.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An application device for applying an application medium to at least one side of a moving product web, the web having a running direction, said application device comprising:

at least one roll supporting the web, at least one said roll and at least one side of the web defining at least one pocket therebetween; and at least one feed apparatus including a metering element with a at least one discharge opening projecting into at least one said pocket, each said metering element defining an application chamber, a first lateral bead and a second lateral bead bounding at least one said application chamber, both said first lateral bead and said second lateral bead extending beyond a corresponding said discharge opening in a direction towards the web, each said discharge opening discharging the application medium onto the web in a direction approximately orthogonal to the running direction and within said application chamber.

2. The application device of claim 1, wherein said metering element includes at least one discharge nozzle approximately centered in the running direction on at least one said application chamber.

3. The application device of claim 1, wherein at least one said application chamber has a position, said position minimizing an orthogonal distance between the web and said at least one application chamber, said position also maintaining an absence of interference between the web and at least said application chamber and between at least one said roll and at least one said application chamber.

4. The application device of claim 3, wherein said metering element includes at least one discharge nozzle approximately centered in the running direction on at least one said application chamber.

5. The application device of claim 1, wherein at least one of said feed apparatus, said metering element and said application chamber are at least one of linearly adjustable and pivotally adjustable.

6. An application device for applying an application medium to at least one side of a moving product web, the web having a running direction, said application device comprising:

at least one roll supporting the web, at least one said roll and at least one side of the web defining at least one pocket therebetween; and at least one feed apparatus including a metering element with a discharge opening projecting into at least one said pocket, each said metering element defining an application chamber, each said discharge opening discharging the application medium onto the web in a direction approximately orthogonal to the running direction and proximate to said application chamber, wherein said metering element includes an attachment defining a corresponding said application chamber, said attachment being replaceable and configured to approximately match a size and a shape of at least one said pocket.

7. The application device of claim 6, wherein said metering element includes at least one discharge nozzle approximately centered in the running direction on at least one said application chamber.

8. The application device of claim 7, wherein at least one said discharge nozzle is a spray nozzle.

9. The application device of claim 8, wherein said at least one discharge nozzle includes a plurality of said spray nozzles which are independently operable, said application chamber including a plurality of planes transverse to the running direction, a plurality of said spray nozzles being arranged in a plurality of said planes.

10. The application device of claim 6, further including a first lateral bead and a second lateral bead bounding at least one said application chamber.

11. The application device of claim 6, further including a first lateral bead and a second lateral bead bounding at least one said application chamber, said first lateral bead and said second lateral bead having an adjustable distance therebetween, said application medium proximate to said application chamber having a pressure, said pressure varying by varying said adjustable distance.

12. The application device of claim 6, wherein at least one said application chamber has a position, said position minimizing an orthogonal distance between the web and said at least one application chamber, said position also maintaining an absence of interference between the web and at least said application chamber and between at least one said roll and at least one said application chamber.

13. The application device of claim 12, further including a first lateral bead and a second lateral bead bounding at least one said application chamber.

14. The application device of claim 12, further including a first lateral bead and a second lateral bead bounding at least one said application chamber, said first lateral bead and said second lateral bead having an adjustable distance therebetween, said application medium proximate to said application chamber having a pressure, said pressure varying by varying said adjustable distance.

15. The application device of claim 12, wherein said metering element includes at least one discharge nozzle approximately centered in the running direction on at least one said application chamber.

16. The application device of claim 15, further including a first lateral bead and a second lateral bead bounding at least one said application chamber.

17. The application device of claim 15, further including a first lateral bead and a second lateral bead bounding at least one said application chamber, said first lateral bead and said second lateral bead having an adjustable distance therebetween, said application medium proximate to said application chamber having a pressure, said pressure varying by varying said adjustable distance.

18. The application device of claim 15, wherein at least one said discharge nozzle is a spray nozzle.

19. The application device of claim 18, wherein said at least one discharge nozzle includes a plurality of said spray nozzles which are independently operable, said application chamber including a plurality of planes transverse to the running direction, a plurality of said spray nozzles being arranged in plurality of said planes.

20. The application device of claim 19, further including a first lateral bead and a second lateral bead bounding at least one said application chamber.

21. The application device of claim 19, further including a first lateral bead and a second lateral bead bounding at least one said application chamber, said first lateral bead and said second lateral bead having an adjustable distance therebetween, said application medium proximate to said application chamber having a pressure, said pressure varying by varying said adjustable distance.

22. The application device of claim, further including a first lateral bead and a second lateral bead bounding at least one said application chamber.

23. The application device of claim 18, further including a first lateral bead and a second lateral bead bounding at least one said application chamber, said first lateral bead and said second lateral bead having an adjustable distance therebetween, said application medium proximate to said application chamber having a pressure, said pressure varying by varying said adjustable distance.

24. An application device for applying an application medium to at least one side of a moving product web, the web having a running direction, said application device comprising:

at least one roll supporting the web, at least one said roll and at least one side of the web defining at least one pocket therebetween; and at least one feed apparatus including a metering element with a discharge opening projecting into at least one said pocket, each said metering element defining an application chamber, each said discharge opening discharging the application medium onto the web in a direction approximately orthogonal to the running direction and proximate to said application chamber, said metering element includes at least one discharge nozzle approximately centered in the running direction on at least one said application chamber, wherein at least one said discharge nozzle is a spray nozzle.

25. The application device of claim 24, wherein said at least one discharge nozzle includes a plurality of said spray nozzles which are independently operable, said application chamber including a plurality of planes transverse to the running direction, a plurality of said spray nozzles being arranged in plurality of said planes.

26. An application device for applying an application medium to at least one side of a moving product web, the web having a running direction, said application device comprising:

at least one roll supporting the web, at least one said roll and at least one side of the web defining at least one pocket therebetween; and at least one feed apparatus including a metering element with a discharge opening projecting into at least one said pocket, each said metering element defining an application chamber, each said discharge opening discharging the application medium onto the web in a direction approximately orthogonal to the running direction and proximate to said application chamber, at least one said application chamber has a position, said position minimizing an orthogonal distance between the web and said at least one application chamber, said position also maintaining an absence of interference between the web and at least said application chamber and between at least one said roll and at least one said application chamber, said metering element includes at least one discharge nozzle approximately centered in the running direction on at least one said application chamber, wherein at least one said discharge nozzle is a spray nozzle.

27. The application device of claim 26, wherein said at least one discharge nozzle includes a plurality of said spray nozzles which are independently operable, said application chamber including a plurality of planes transverse to the running direction, a plurality of said spray nozzles being arranged in plurality of said planes.

28. An application device for applying an application medium to at least one side of a moving product web, the web having a running direction, said application device comprising:

at least one roll supporting the web, at least one said roll and at least one side of the web defining at least one pocket therebetween; and at least one feed apparatus including a metering element with a discharge opening projecting into at least one said pocket, each said metering element defining an application chamber, each said discharge opening discharging the application medium onto the web in a direction approximately orthogonal to the running direction and proximate to said application chamber, further including a first lateral bead and a second lateral bead bounding at least one said application chamber.

29. An application device for applying an application medium to at least one side of a moving product web, the web having a running direction, said application device comprising:

at least one roll supporting the web, at least one said roll and at least one side of the web defining at least one pocket therebetween; and at least one feed apparatus including a metering element with a discharge opening projecting into at least one said pocket, each said metering element defining an application chamber, each said discharge opening discharging the application medium onto the web in a direction approximately orthogonal to the running direction and proximate to said application chamber, further including a first lateral bead and a second lateral bead bounding at least one said application chamber, said first lateral bead and said second lateral bead having an adjustable distance therebetween, said application medium proximate to said application chamber having a pressure, said pressure varying by varying said adjustable distance.

* * * * *

UNITED STATES PATENT AND TRADEMARK OFFICE

CERTIFICATE OF CORRECTION

PATENT NO. : 6,726,770 B2
DATED : April 27, 2004
INVENTOR(S) : Eichinger

It is certified that error appears in the above-identified patent and that said Letters Patent is hereby corrected as shown below:

Column 5,
Line 35, after “with”, delete “a”.

Column 7,
Line 19, please delete “claim,”, and substitute therefore -- claim 18, --.

Signed and Sealed this

Seventh Day of September, 2004

JON W. DUDAS
*Director of the United States Patent and Trademark Office*